US005412170A

United States Patent [19]

Hofmann et al.

[11] Patent Number: 5,412,170

[45] Date of Patent: May 2, 1995

[54] ELECTRIC SWITCH WITH SLIDING BRIDGING CONTACT

[75] Inventors: Georg Hofmann, Heilbronn-Horkheim; Hubert Spazierer; Adam Weber, Bietigheim-Bissingen, all of Germany

[73] Assignee: ITT Automotive Europe GmbH, Germany

[21] Appl. No.: 117,544

[22] Filed: Sep. 3, 1993

Related U.S. Application Data

[63] Continuation of Ser. No. 836,309, Feb. 28, 1992, abandoned.

[30] Foreign Application Priority Data

Jun. 29, 1990 [DE] Germany ..... 40 20 821.4

[51] Int. Cl.[6] ..... H01H 1/36

[52] U.S. Cl. ..... 200/536; 200/284; 200/260; 200/252; 200/531

[58] Field of Search ..... 200/284, 260, 252, 274, 200/531, 536, 541, 550, 563, 571, 547, 560, 561, 572, 16 A, 16 R

[56] References Cited

U.S. PATENT DOCUMENTS

| | | | |
|---|---|---|---|
| 3,097,269 | 7/1963 | Campbell . | |
| 3,293,399 | 12/1966 | Heinrich . | |
| 3,319,016 | 5/1967 | Hoy et al. | 200/561 |
| 3,339,032 | 8/1967 | Hults | 200/561 |
| 4,042,795 | 8/1977 | Sykora . | |
| 4,563,551 | 1/1986 | Black, III et al. . | |
| 4,616,112 | 10/1986 | Galloway et al. . | |
| 4,766,272 | 8/1988 | Guzzon . | |

FOREIGN PATENT DOCUMENTS

| | | | |
|---|---|---|---|
| 87944 | 10/1959 | Denmark | 200/284 |
| 329968 | 8/1989 | European Pat. Off. | 200/284 |
| 610395 | 10/1960 | Italy | 200/284 |

*Primary Examiner*—Henry J. Recla
*Assistant Examiner*—David J. Walczak
*Attorney, Agent, or Firm*—Robert P. Seitter; J. Gordon Lewis

[57] ABSTRACT

In an electric switch a good gliding behavior between a bridging contact and metal conductors punched out from a sheet metal blank is achieved. For this purpose the metal conductors have at least one projection extending at least over the entire range of motion of the bridging contact.

16 Claims, 5 Drawing Sheets

Fig.8
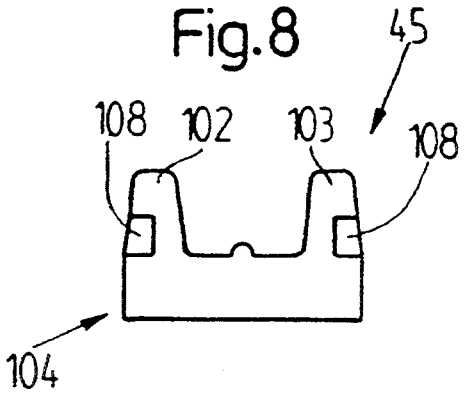
Fig. 9
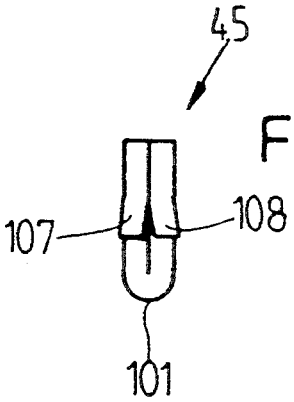
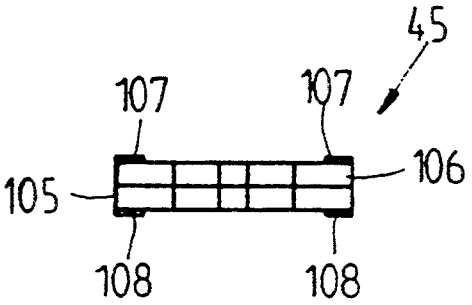
Fig.10
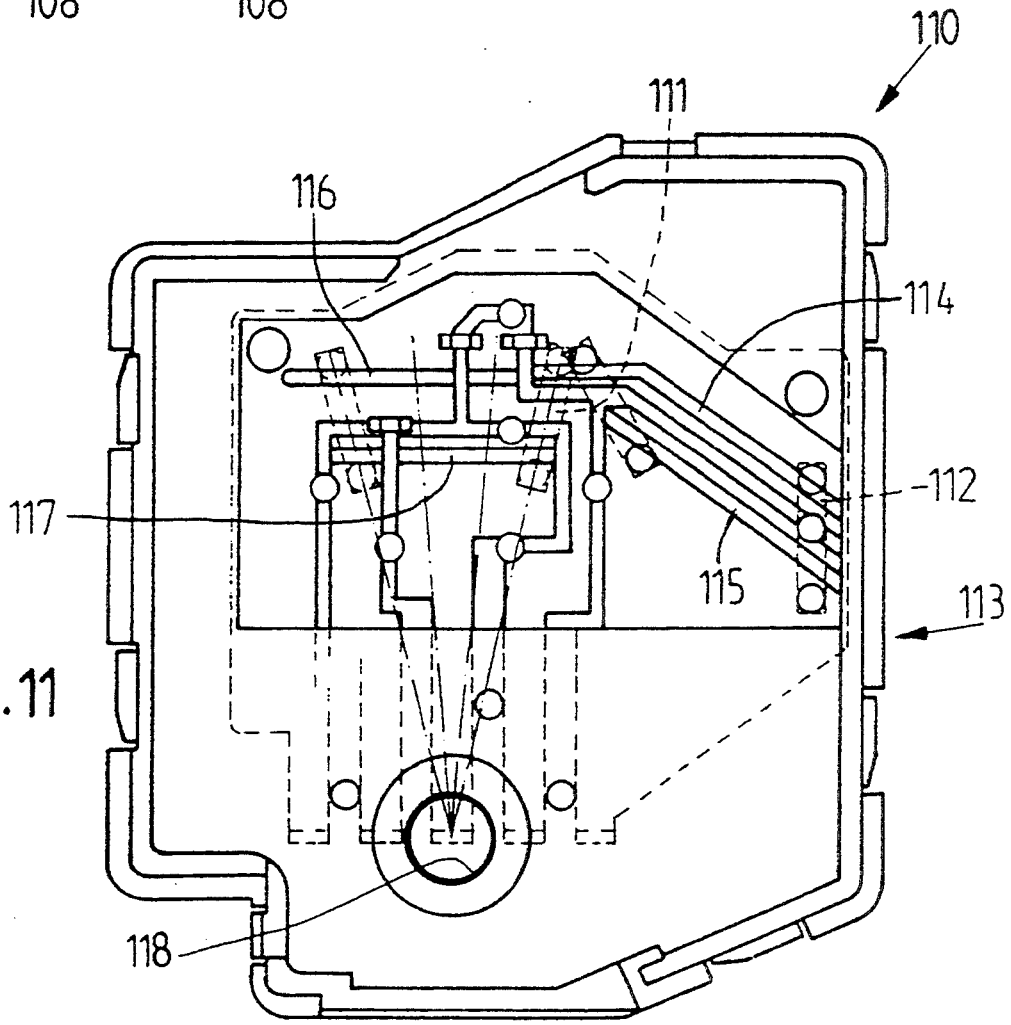
Fig.11

ELECTRIC SWITCH WITH SLIDING BRIDGING CONTACT

This application is a continuation of application Ser. No. 07/836,309, filed on Feb. 28, 1992, now abandoned.

BACKGROUND OF THE INVENTION

1. Field of the Invention

This invention relates to an electric switch.

2. State of the Art

In customary switches of this kind the metal conductors are formed as planar surface segments of a sheet metal blank cut out by punching from the originally complete sheet metal. The metal conductors are at first still connected with one another by connecting webs so that the sheet metal blank can be embedded as a whole in a base plate of insulating material and, in the injection molding process of the base plate, the base plate is partially injection molded around the metal conductors. The connecting webs between the metal conductors are afterwards cleared away by purposefully drilling through the base plate and the connecting webs.

One or more bridging contacts are positioned in a guiding and actuating device by means of which they can be moved along the associated metal conductors. Thereby the bridging contacts rest against the metal conductors under the effect of pressure springs.

In dependence on the desired switching operations two of the metal conductors extending in parallel to each other and over which a bridging contact is jointly moved are either interrupted both or only one in particular places, so that, with precision, two or more metal conductors partially having different lengths are located behind one another. In the transitional places between two of these metal conductors located one behind the other either the space between them is filled with insulating material of the base plate up to the level of the metal conductors or there is a gap between them.

The bridging contacts are mostly punched out from sheet metal blanks. Sometimes they are additionally bent. If considerable production tolerances appear on the guiding and operating device for the bridging contact and/or on the base plate including the metal conductors generally produced as injection molded parts, for example, the surface of the base plate reaches the same level as the surface of one of the metal conductors or is even slightly higher so that the electric switching properties of such a switch are heavily impaired. When in a transitional plate the space between the metal conductors is filled with insulating material, the bridging contact can more easily glide over the transitional place. However, then it is a risk that in the process of injection molding around the metal conductors insulating material may be brought onto the metal conductor causing difficulties in making contact later on, for example, a delayed switch contact or a premature interruption of the contact. If, in the transitional places of the metal conductors, a gap is formed by an appropriate molding, undesired insulating material will not impede the making of contact. However, the risk of a deteriorated gliding behavior of the bridging contact may come into existence and the course of motion in the transitional places may be more or less impeded.

SUMMARY OF THE INVENTION

It is an object of the present invention to develop a switch in such a way that its electric switching properties are improved at low cost. This problem is solved in one embodiment of the present invention in which the metal conductors have at least one projection extending over the entire area of motion of the bridging contact with the only exception of the transitional places between two metal conductors located one behind the other. The bridging contact exclusively rests against the projection of the metal conductors assigned to one another. This results in a clearly defined contact surface between the contact elements co-operating in pairs. This also results in constantly reliable switching properties to a far-reaching extent independent of possible production tolerances of the metal parts and the plastic parts receiving them.

When the switch is developed with the projections formed as a bulge of the sheet metal blank, the projections can be made very simply at very favorable costs.

When the switch is developed according to another embodiment in which the transitional place of the two metal conductors are positioned one behind the other, the transition of the bridging contact is considerably facilitated and the bridging contact is prevented from getting caught. When the switch is developed according to yet another embodiment, it is achieved that in a transitional place the bridging contact is moved from one metal conductor to that behind it without changing its height and, thus, also without mechanical interruption or disturbance of the course of motion.

In a construction of the switch according to another embodiment, it is achieved that during the longitudinal movement of the bridging contact on its associated metal conductors the contact point between the bridging contact and the projection on each one of the two metal conductors on the bridging contact continuously changes its position. Thus, sticking of the projection of the metal conductor to the surfaces of the bridging contact against which they rest is avoided. This increases the service life of the bridging contact and prevents difficulties in making contact caused by contact wear.

In a development of the switch in which the bridging contact is formed by a folded sheet metal blank, the bridging contact gets a cylindrically shaped bearing and a contact surface without burrs which is in both directions of motion effective as a skid. Thereby the gliding behavior of the bridging contact on the metal conductors and on the transitional places is considerably improved and, in addition, troubles with respect to the course of motion are reduced, especially in the transitional places. All this is achieved in a very favorable manner as far as costs are concerned. By another design of the switch it is also made possible to arrange detents in pairs extending in opposite directions in the vicinity of both front sides of the bridging contact. This results in a symmetrical mounting of the bridging contact in the guiding and operating device thereby avoiding the bridging contact from being brought into a slanting position or from being tilted. A bridging contact of this kind is also advantageously used independently of the features of the other embodiments of the present invention.

BRIEF DESCRIPTION OF THE DRAWINGS

The invention will now be described in detail by way of several embodiments shown in the accompanying drawings, in which:

FIG. 8 is a side elevational view of a bridging contact of the switch;

FIG. 9 is a front elevational view of the bridging contact according to FIG. 8;

FIG. 10 is a plan view of the bridging contact according to FIG. 8;

FIG. 11 is a plan view of the bottom of another embodiment of the switch including metal conductors;

DESCRIPTION OF THE PREFERRED EMBODIMENTS

Figure 1:
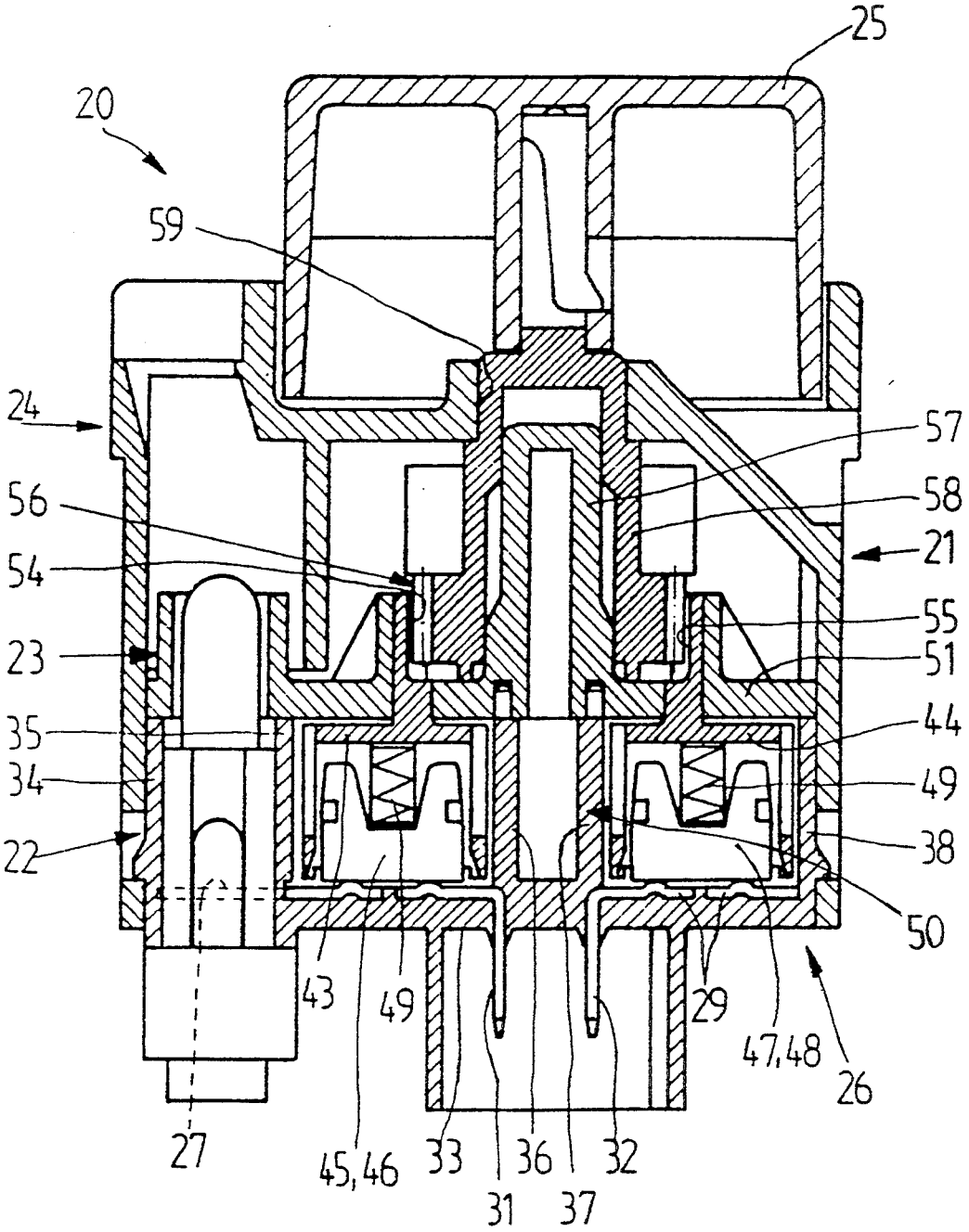
FIG. 1 is a vertical cross sectional view of the switch including a bottom, top and cover.
Figure 2:
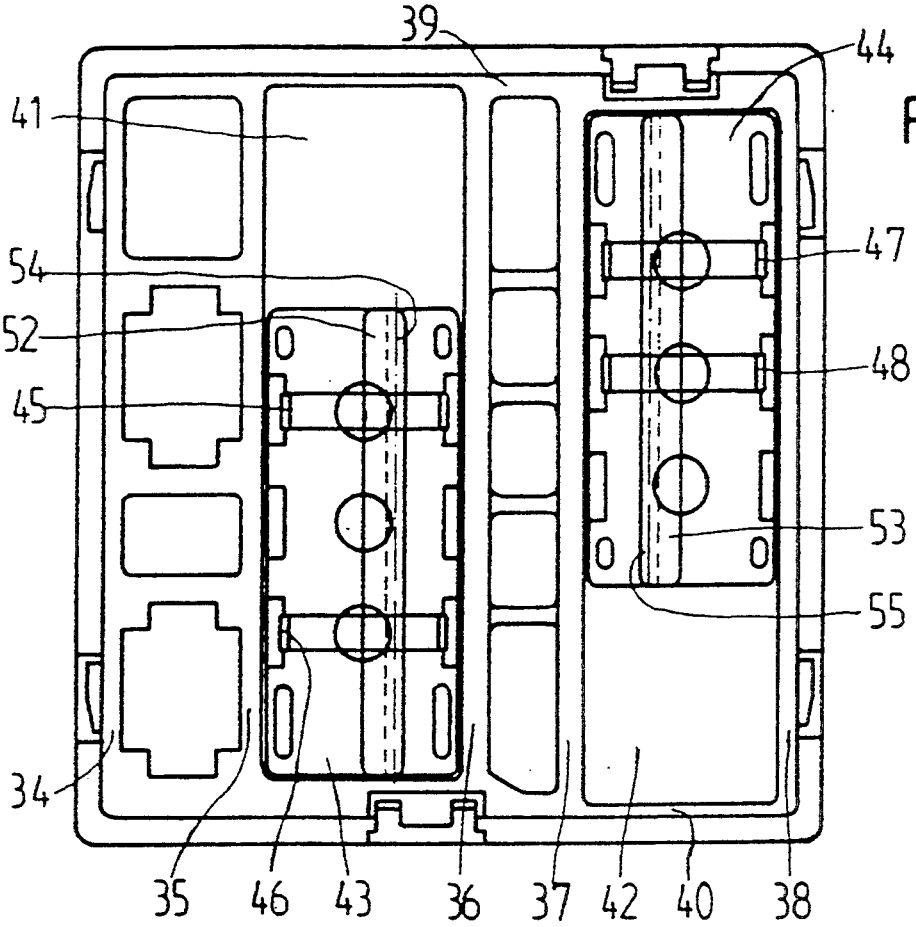
FIG. 2 is a plan view of the switch with the top and cover removed.
Figure 3:
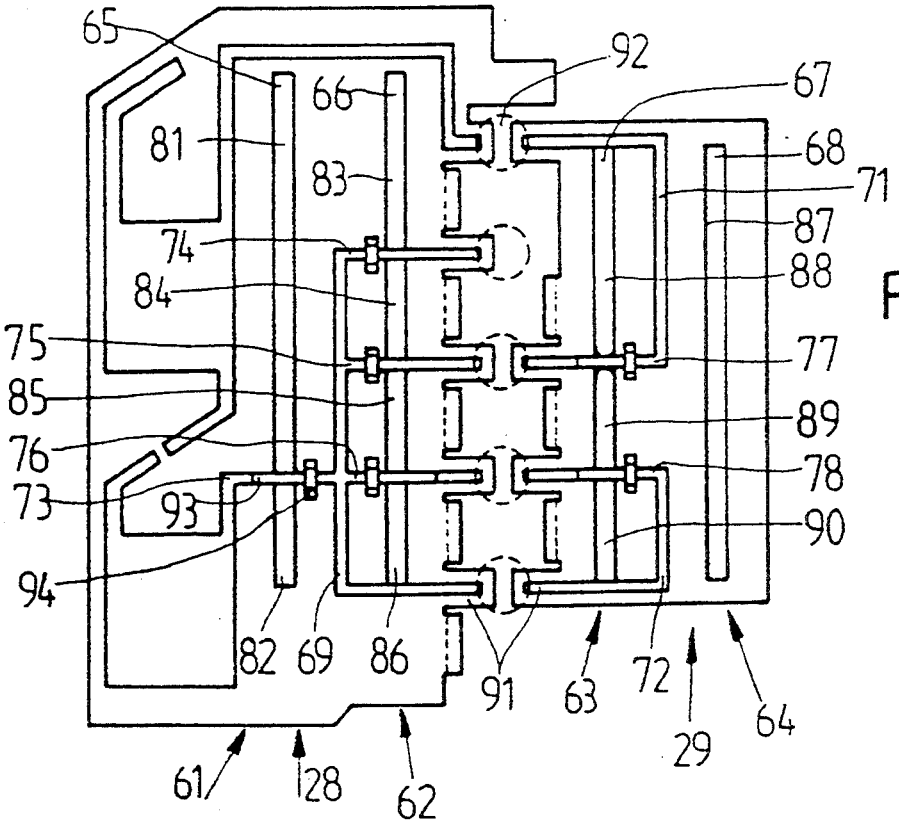
FIG. 3 is a plan view of a sheet metal blank with the metal conductors for the bottom of the switch.

The switch 20 of the embodiment to be seen from FIGS. 1 to 3 includes a housing 21 formed by a bottom 22, a top 23 and a cover 24. An operating knob 25 is arranged on the cover 24.

The bottom 22 is made by injection molding from a thermoplastic material having good electric insulating properties. The bottom 22 comprises a base plate 26, in the upper side 27 of which are embedded two sheet metal blanks 28 and 29 with various metal conductors (FIG. 3) and the associated connecting lugs 31 and 32 (FIG. 1). The connecting lugs 31 and 32 project vertically downwards from the underside 33 of the base plate 26 and are aligned in two rows.

Five longitudinal walls 34 to 38 and two transverse walls 39 and 40 are arranged on the upper side 27 of the base plate 26. The five longitudinal walls 34 to 38 are arranged with a particular spacing in parallel to one another and with their two ends adjoining the transverse walls 39 and 40. Thus, the two outer longitudinal walls 34 and 38 form together with the transverse walls 39 and 40 a closed enveloping wall of the bottom 22.

The two longitudinal walls 35 and 36 as well as the two longitudinal walls 37 and 38 are spaced from one another with the same clear spacing. Together with the associated portion of the transverse walls 39 and 40 they each border a chamber 41 or 42. Therein a slide 43 or 44 is accommodated, which slide 43 or 44 is shorter than the associated chamber 41 or 42. The internal width of the chamber 41 and 42 and the width of the slides 43 and 44 are adapted to one another in such a way that the slides 43 and 44 are linearly guided in the chambers 41 and 42, respectively.

The slides 43 and 44 are developed in the same way. Each of the slides 43 and 44 has three recesses which are transversely aligned to its direction of displacement. The recesses are open in a downward direction, that is, towards the base plate 26, and at least partially closed in the upward direction. In accordance with the requirements of the circuit diagram, a bridging contact is inserted into one or each of several of the recesses. With regard to the slide 43, there are the two bridging contacts 45 and 46. With regard to the slide 44, there are the two bridging contacts 47 and 48. The bridging contacts are each pressed downwards by a helical compression spring 49, which is supported at the cover 24 of the slide.

The longitudinal walls 35 and 36 as well as walls 37 and 38 assigned to each other in pairs and the base plate 26 together form part of a guiding and operating device 50 for the slides 43 and 44 and the bridging contacts arranged thereon. The chambers of the bottom part, in particular, the chambers 41 and 42 for the slides 43 or 44, respectively, are covered by the top part having a bottom 51, the underside of which is at least smooth and planar in the area of the chambers 41 and 42. Thus, the bottom 51 of the top part 23 forms another component part of the guiding and operating device 50. It prevents the slides 43 and 44 from giving way in an upward direction due to the reaction force of the helical compression springs 49.

In the area of the base of the two chambers 41 and 42, the bottom 51 is provided with a longitudinal slot of a particular width. Through this slot extends an operating rib 52 or 53 each firmly connected with the slide 43 or 44 and, in general, integrally formed onto it. The operating ribs 52 and 53 are provided with a rack profile 54 or 55, respectively, on the sides facing each other. This rack profile engages a pinion 56 which is rotatably mounted by means of a vertically aligned bearing pin 57. The bearing pin 57 is integrally formed onto the upper part 23. The hub 58 of the pinion 56 extends through an opening 59 in the cover 24. The operating knob 25 is connected with the hub 58 in a manner protected against twisting.

Figure 4:
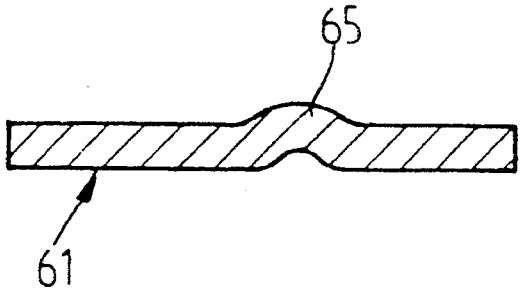
FIG. 4 is a cross-section of an individual metal conductor.

The two sheet metal blanks 28 and 29 connected with the base plate 26 (FIG. 3) include two portions 61 and 62 or 63 and 64, respectively, which relative to the center plane of the slides 43 or 44 are arranged beside each other. Alongside the center line of each blank portion the sheet metal blank is provided with a projection each having the shape of a bulge as is illustrated in FIG. 4 for the blank portion 61 by the projection 65. In the same manner the blank portion 62 is provided with the projection 66, the blank portion 63 with the projection 67 and the blank portion 64 with the projection 68. Against these projections rest the bridging contacts in the slides 43 and 44, so that an exactly defined contact point is reached. In addition, each projection may be formed as a metal coating on the sheet metal blank.

In accordance with the requirements of the circuit diagram for the switch 20, the two blank portions 61 and 62 as well as the blank portions 63 and 64 assigned to each other are either partially connected or separated from each other by means of longitudinally extending punchings 69, 71 or 72. The blank portions 61 to 64 are divided into individual portions of different lengths by means of transversely extending punchings each adjoining one of the longitudinally extending punchings 69, 71 or 72. These longitudinal portions form the metal conductors 81 to 86 in the area of the sheet metal blank 28 and the metal conductors 87 to 90 in the area of the sheet metal blank 29.

In order to facilitate the insertion of the sheet metal blanks 28 and 29 in the mold in the production process of the bottom part 22 and in the process of injection molding therearound, the connecting lugs 31 or 32 are arranged in the inside rim of the sheet metal blanks 28 and 29, which connecting lugs in the longitudinal direction of the adjacent metal conductors are at first connected to one another by means of a web 91 to retain a proper arrangement and alignment of the various metal conductors. These webs 91 are later on removed by a bore 92 each indicated by dash-dotted lines in FIG. 3. In a similar way webs also exist in other plates of the sheet metal blanks which are later also removed by a bore.

Figure 5:
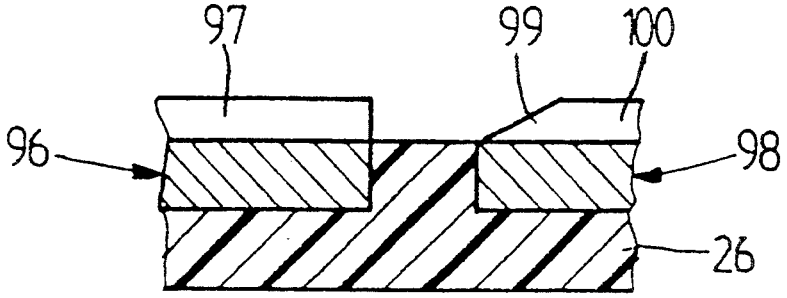
FIG. 5 is a partial longitudinal cross sectional view of the bottom of the switch in the vicinity of a transitional place between two metal conductors.
Figure 6:
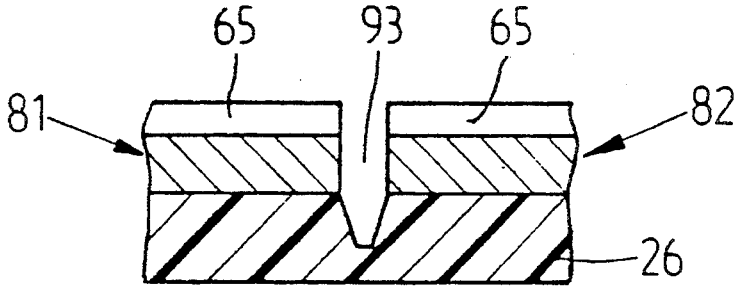
FIG. 6 is a partial longitudinal cross sectional view of a modified switch bottom in the vicinity of a transitional place.

In the transitional place between two metal conductors positioned one behind the other in the direction of displacement of the slides 42 and 44, the material of the base plate 26 can be positioned at the same level as the sheet metal blank outside of the projections of the metal conductors as is shown in FIG. 5. However it is more suitable if the baseplate 26 has a slot 93 between two metal conductors positioned one behind the other as is shown in FIG. 6.

Figure 7:
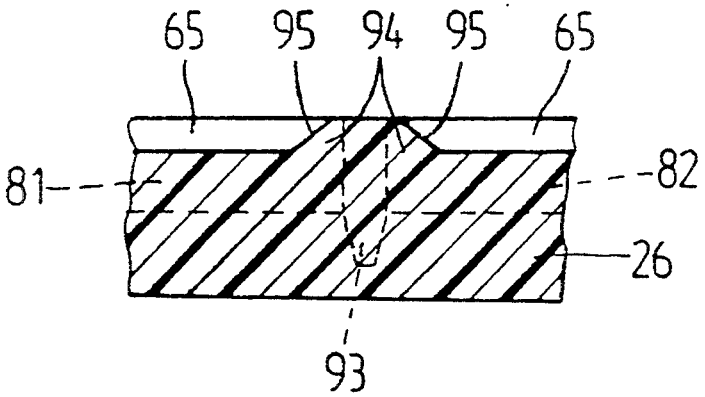
FIG. 7 is a partial longitudinal cross sectional view of the switch bottom according to FIG. 6 in parallel to the section according to FIG. 6.

In order to provide that the bridging contact will not get caught on such a transitional place or its displacement is only disturbed, it is suitable to arrange a guide rib 94 at least on one side of the metal conductor (FIG. 7). The height of the guide rib 94 is at least substantially the same as the height of the projections adjacent to the gap 93, for example the projection 65, of the metal conductors positioned one behind the other in the transitional place, for example the metal conductors 81 and 82. Alternately, the height of the guide rib 94 is at most slightly higher than the projections. In both directions the slope portions 95 adjoin the guide rib 94, which slope portions 95 facilitate a gliding upwards of the bridging contact on the guide rib 94.

The gliding of a bridging contact from a projection of one metal conductor to a projection of the other metal conductor or from one guide rib to the projection of an adjacent metal conductor can also be facilitated in that in the transitional place the projection of the metal conductor does not end with sharp edges, as is shown at the left-hand side of FIG. 5 by way of the metal conductor 96 and its projection 97, but that the end portion of the metal conductor is constructed in a sloped manner as can be seen on the right-hand side of FIG. 5 by way of the metal conductor 98 and the end portion 99 of its projection 100.

The improvement of the gliding properties of the bridging contacts on the metal conductors and also the electric switching capabilities of these parts is additionally improved in that the bridging contacts 45 to 48 are formed by a folded sheet metal portion as can be seen from FIGS. 8 to 10. The folded back of a bridging contact of this kind, just as the folded back 101 of the bridging contact 45 (FIG. 9), faces the metal conductors. These bridging contacts are at first punched out in the shape of an H. They are folded alongside the center line of the web of the H-profile, so that thereafter they have a U-shaped side view (FIG. 8). In the center of the web, the bridging contacts have a small projection which serves to guide the helical compression springs 49.

Due to its being developed from a symmetrically formed sheet metal blank a detent 107 or 108 is formed in the area of each of the two front sides 105 and 106 of the bridging contact on both shanks 102 and 103 of the sheet metal portion 104 which is made by a release and simultaneous slight bending, as long as the sheet metal blank 104 has not been folded. Each of the bridging contacts can be engaged on a locking surface of the slide both in the longitudinal direction and in the transverse direction.

Figure 12:
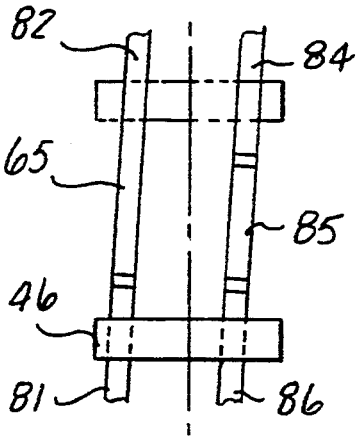
FIG. 12 is a plan view of another embodiment of the metal conductors and the bridging contact.
Figure 13:
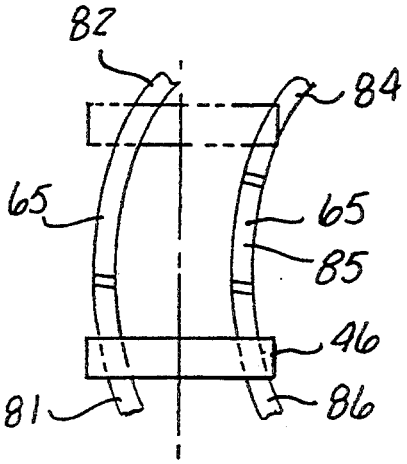
FIG. 13 is a plan view of yet another embodiment of the metal conductors and the bridging contact.

In order to reduce the mechanical wear of the projections it is suitable to give the projection at least partially a course which within the width of a bridging contact deviates from the line of motion of a particular point of the bridging contact, so that in a relative movement of the bridging contact with regard to the metal conductors the contact point does not only move on the metal conductors but also on the bridging contact. This is illustrated by the embodiment of a switch 110 according to FIG. 11. In this embodiment, the bridging contacts 111 and 112 are arranged on a single swivelling member, not shown in detail in the drawing, which is swivellably mounted on the bottom part 113 by means of a circular recess 118. Each of the bridging contacts 111 and 112 move during a swivelling motion of the swivelling member on a circular path of motion. All of the metal conductors with their projections 114 to 117 extend linearly. This is why in a movement of the swivelling member a relative motion of the projection of the metal conductor relative to the folded back portion is always started. A relative motion of the contact point on the bridging contacts reducing wear can also be reached by another combination of the course of the path of motion of a bridging contact and the base of the projection of the metal conductors co-operating with it. In a linear movement of the bridging contact the basis of the projection of the metal conductors co-operating with it can also be a straight line, which however includes a pointed angle with the line of motion of a point of the bridging contact as shown in FIG. 12, or a curved path as shown in FIG. 13. In a curved, in particular, a circular path of motion of the bridging contact, the base of the projection of the metal conductors can as well be curved or circular as long as the line of motion of a point of the bridging contact is not congruent with the course of the projection.

What is claimed is:

1. An electric switch comprising:

a sheet metal blank having a plurality of elongated metal conductors formed therefrom, the metal conductors arranged in two longitudinally extending, co-linear lines;

a base plate formed of an insulating material, the base plate connected to the sheet metal blank;

a bridging contact spanning the two lines of metal conductors;

guiding and operating means for sliding the bridging contact in a predetermined range of motion along the metal conductors; and a projection formed on each metal conductor and extending substantially over an entire range of motion of the bridging contact over each metal conductor;

two of the metal conductors being arranged longitudinally one behind the other in a direction of motion of the bridging contact to form a transitional place therebetween;

end portions of the projections on the two metal conductors facing each other adjacent the transitional place having a sloping shape.

2. An electric switch comprising:

a sheet metal blank having a plurality of elongated metal conductors formed therefrom, the metal conductors arranged in two longitudinally extending, co-linear lines;

a base plate formed of an insulating material, the base plate connected to the sheet metal blank;

a bridging contact spanning the two lines of metal conductors;

guiding and operating means for sliding the bridging contact in a predetermined range of motion along the metal conductors; and a projection formed on each metal conductor and extending substantially over an entire range of motion of the bridging contact over each metal conductor;

two of the metal conductors being arranged longitudinally one behind the other in a direction of motion of the bridging contact to form a transitional place therebetween; and a guide rib disposed on at least one side of the two metal conductors, the guide rib being spaced from and aligned substantially in parallel to a path of motion of the bridging contact and extending at least substantially from an end of the projection of one metal conductor to a beginning of the projection on the other metal conductor positioned longitudinally behind the one metal conductor.

3. The electric switch of claim 2 wherein the projection on each of the metal conductors is formed as a bulge extending from the sheet metal blank.

4. The electric switch of claim 2 wherein the projection on each of the metal conductors is formed as metal coating on the sheet metal blank.

5. The electric switch of claim 2 wherein the guide rib has at least a same height as the projections on the metal conductors adjacent the transitional place.

6. The electric switch of claim 2 wherein the guide rib has a slope in the direction of motion of the bridging contact.

7. The electric switch of claim 2 wherein:

the bridging contact is formed of a folded sheet metal blank having a central end portion and a pair of closely spaced folded-back shank portions, the central end portion extending towards the metal conductors.

8. The electric switch of claim 7 wherein:

a detent is formed on at least one shank of the folded sheet metal blank in an area of each side of the bridging contact and bent outward therefrom, a locking surface of the detent being turned towards the bent portion of the detent.

9. An electric switch comprising:

a sheet metal blank having a plurality of elongated metal conductors formed therefrom, the metal conductors arranged in two spaced, identical paths;

a base plate formed of an insulating material, the base plate connected to the sheet metal blank;

a bridging contact spanning the two paths of metal conductors;

guiding and operating means for sliding the bridging contact in a predetermined range of motion along the metal conductors in a straight path of motion; and a projection formed on each metal conductor and extending substantially over an entire range of motion of the bridging contact over each metal conductor, the projection on each metal conductor has at least a course which, within a width of a path of motion of the bridging contact, deviates from a line of motion of a point of the bridging contact;

two of the metal conductors being arranged end to end in a direction of motion of the bridging contact, adjacent ends of the two metal conductors being spaced apart to form a transitional place therebetween; and a guide rib disposed in the transitional place between the adjacent ends of the two metal conductors, the guide rib extending at least substantially from an end of the projection of one metal conductor to a beginning of the projection on the other metal conductor.

10. The electric switch of claim 9 wherein the path of motion of the bridging contact is a straight path of motion and wherein:

the projection of the metal conductor extends linearly at an angle with the line of motion of the point of the bridging contact.

11. An electric switch comprising:

a sheet metal blank having a plurality of elongated metal conductors formed therefrom, the metal conductors arranged in two longitudinally extending, co-linear lines;

a base plate formed of an insulating material, the base plate connected to the sheet metal blank;

a bridging contact spanning the two lines of metal conductors;

guiding and operating means for sliding the bridging contact in a predetermined range of motion along the metal conductors in a straight path of motion; and a curved projection formed on each metal conductor and extending substantially over an entire range of motion of the bridging contact over each metal conductor;

two of the metal conductors being arranged longitudinally end to end in a direction of motion of the bridging contact, adjacent ends of the two metal conductors being spaced apart to form a transitional place therebetween; and a guide rib disposed in the transitional place between the adjacent ends of the two metal conductors, the guide rib extending at least substantially from and end of the projection of one metal conductor to a beginning of the projection on the other metal conductor.

12. An electric switch comprising:

a sheet metal blank having a plurality of elongated metal conductors formed therefrom, the metal conductors arranged in two spaced, identical paths;

a base plate formed of an insulating material, the base plate connected to the sheet metal blank;

a bridging contact spanning the two paths of metal conductors;

guiding and operating means for sliding the bridging contact in a predetermined range of motion along the metal conductors in an arc-shaped path of motion; and a linear projection formed on each metal conductor and extending substantially over an entire range of motion of the bridging contact over each metal conductor alongside a chord of the path of motion of a point of the bridging contact;

two of the metal conductors being arranged end to end in a direction of motion of the bridging contact, adjacent ends of the two metal conductors being spaced apart to form a transitional place therebetween; and a guide rib disposed in the transitional spaced between adjacent ends of the two metal conductors, the guide rib extending at least substantially from an end of the projection of one metal conductor to a beginning of the projection on the other metal conductor.

13. An electric switch comprising:

a sheet metal blank having at least two metal conductors formed therefrom;

a base plate formed of an insulating material, the base plate connected to the sheet metal blank;

a bridging contact;

two metal conductors being arranged end to end in a direction of motion of the bridging contact, adjacent ends of the two metal conductors being spaced apart to form a transitional place therebetween;

guiding and operating means for moving the bridging contact in a predetermined range of motion over the metal conductors; and a projection formed on each metal conductor and extending over the entire range of motion of the bridging contact, end portions of the projections facing each other adjacent the transitional place having a sloping shape; and a guide rib disposed in the transitional space between adjacent ends of the two metal conductors, the guide rib being spaced from and aligned substantially in parallel to a path of motion of the bridging contact and extending at least substantially from an end of the projection of one metal conductor to a beginning of the projection on the other metal conductor.

14. An electric switch comprising:

a sheet metal blank having a plurality of elongated metal conductors formed therefrom, the metal conductors arranged in two spaced, identical paths;

a base plate formed of an insulating material, the base plate connected to the sheet metal blank;

a bridging contact spanning the two paths of metal conductors;

guiding and operating means for sliding the bridging contact in a predetermined range of motion along the metal conductors in an arc-shaped path of motion; and a curved projection formed on each metal conductor and extending substantially over an entire range of motion of the bridging contact over each metal conductor;

two of the metal conductors being arranged end to end in a direction of motion of the bridging contact, adjacent ends of the two metal conductors being spaced apart to form a transitional place therebetween; and a guide rib disposed in the transitional space between adjacent ends of the two metal conductors, the guide rib extending at least substantially from an end of the projection of one metal conductor to a beginning of the projection on the other metal conductor.

15. The electric switch of claim 14 wherein:

the projection on each metal conductor has a radius of curvature, the radius of curvature of the projection extending in the same direction from a center as a radius of curvature of the path of motion of the bridging contact, the radius of curvature of the projection being different than the radius of curvature of the path of motion of the bridging contact.

16. The electric switch of claim 14 wherein:

the projection on each metal conductor has a radius of curvature, the radius of curvature of the projection extending in an opposite direction from a center as a radius of curvature of the path of motion of the bridging contact, the radius of curvature of the projection being different from the radius of curvature of the path of motion of the bridging contact.

* * * * *